US006702063B1

(12) United States Patent
Yamaguchi et al.

(10) Patent No.: US 6,702,063 B1
(45) Date of Patent: Mar. 9, 2004

(54) SURFACE MATERIAL AND METHOD OF SUPPRESSING INFLUENCE OF SURFACE WAVE

(75) Inventors: Toru Yamaguchi, Tokyo (JP); Hiroyuki Tone, Tokyo (JP); Mitsuru Tanabe, Nishinomiya (JP); Masaki Maekawa, Otsu (JP)

(73) Assignees: AICA Engineering Co. Ltd. (JP); Toray Industries, Inc. (JP)

( * ) Notice: Subject to any disclaimer, the term of this patent is extended or adjusted under 35 U.S.C. 154(b) by 0 days.

(21) Appl. No.: 10/031,475

(22) PCT Filed: May 25, 2000

(86) PCT No.: PCT/JP00/03352

§ 371 (c)(1),
(2), (4) Date: Jan. 17, 2002

(87) PCT Pub. No.: WO01/91104

PCT Pub. Date: Nov. 29, 2001

(51) Int. Cl.[7] ..... E04B 1/74
(52) U.S. Cl. ..... 181/294; 181/284
(58) Field of Search ..... 181/284, 294

(56) References Cited

U.S. PATENT DOCUMENTS 5,064,019 A * 11/1991 Murakami et al. ..... 181/170
5,547,743 A * 8/1996 Rumiesz et al. ..... 442/348
5,899,785 A * 5/1999 Groten et al. ..... 442/334
5,970,583 A * 10/1999 Groten et al. ..... 19/296

* cited by examiner

*Primary Examiner*—Robert Nappi
*Assistant Examiner*—David Warren
(74) *Attorney, Agent, or Firm*—Piper Rudnick LLP

(57) ABSTRACT

The present invention provides a surface material comprising a fibrous structure having a weight average single fiber thickness of from 0.0001 to 1 dtex, a thickness of from 0.10 to 5 mm and a unit weight of from 50 to 500 g/m$^2$, and disposed on a surface of a body in order to convert at least a part of a surface wave, generated on the surface of the body by vibration of the body, into a vibration of the fibrous structure, and a method for suppressing the influence due to the surface wave. In the present invention, by disposing the surface material on surfaces of various members receiving vibration, a modulation of the vibration originating from the surface wave which greatly influences a human acoustic sense can be efficiently suppressed, and a sound quality and an image quality can be prevented from being deteriorated.

22 Claims, No Drawings

SURFACE MATERIAL AND METHOD OF SUPPRESSING INFLUENCE OF SURFACE WAVE

TECHNICAL FIELD OF THE INVENTION

The present invention relates to a surface material disposed on a surface of a body receiving a vibration and a method for suppressing influence due to a surface wave generated on the surface of the body by a vibration.

BACKGROUND OF THE INVENTION

In a vibration transmittable member, although a given vibration propagates into an interior of the member mainly as a longitudinal vibration (namely, a stretching vibration in a direction of the progress of the vibration) depending on the Young's modulus in the region having a size corresponding to the amplitude, in all substances a transverse vibration (namely, a stretching vibration in a direction perpendicular to the direction of the progress of the vibration) also generates depending on the modulus of transverse elasticity. This transverse vibration becomes a surface wave (namely, a concave/convex surface wave such as a surface wave of water). In the surface wave, because not only there is a stationary phase lag but also there occur modulation distortion and phase distortion depending on the microscopic form and crystalline condition of the member surface, it becomes a great inflection point on mechanical impedance, and most of the surface wave re-propagates into the interior of the member. This causes a great influence in precision instruments and acoustic equipments.

In consideration of acoustic reflection and absorption surfaces defining an acoustic space, in a reflection surface, when an acoustic wave hits the surface, an adiabatic compression occurs and subsequently an adiabatic expansion occurs, and the acoustic wave turns as if a light reflects from a mirror. However, because there is no complete rigid material in practice, the energy of the acoustic wave is once converted into a vibration of the member, and further, a part thereof becomes a thermal energy and the remaining part reflects receiving a modulation due to an intrinsic property of the member. Therefore, even if the reflectances of the acoustic energy are the same, the waveforms of the reflected acoustic waves are different from each other depending upon the surface conditions of the members. Namely, the tone of the reflected sound varies by the above-described non-stationary noise originating from the surface wave.

Moreover, in an acoustic absorption m ember, because the conversion into a thermal energy is great as well as the modulation due to the intrinsic property of the member is remarkably great, even if the absolute amount of the reflectance is small, the tone is greatly influenced more than in a reflection surface. In other words, a peculiarity is likely to appear in a soft acoustic absorption surface much more than in a hard acoustic reflection surface.

In the conventional technology, although sound absorbing acoustic materials such as a rock wool, a glass wool and a worsted felt have been used, even if the purpose for absorbing sound can be achieved as a stationary property, there may occur an acoustic component uncomfortable on acoustic sense, such as non-stationary noise having a high frequency.

For example, in a theater hall or a concert hall, the above-described acoustic materials are partially used by a single or composite formation in order to control the acoustic property of the inside of the hall. Further, similar acoustic materials also are used for chairs disposed in the hall in order to control the acoustic property of the hall. When such conventional acoustic materials are used, however, the tone on acoustic sense indicates a distortional feeling and a turbid feeling, and it is not preferable.

As described hereinabove, the distortional feeling or the turbid feeling due to the non-stationary noise originating from the surface wave influences not only the acoustic materials but also all materials transmitting vibration. For example, even in equipments handling images, the surface wave of a base material forming an equipment greatly influences the obtained image quality.

DISCLOSURE OF THE INVENTION

An object of the present invention is to provide a surface material which can suppress an influence due to a surface wave generated on a surface of a body by a vibration, which can prevent deterioration of a sound quality or can obtain a clearer image quality by suppressing generation of non-stationary noise having a high frequency uncomfortable to a man, and a method for suppressing an influence due to a surface wave by using the surface material.

To accomplish the above object, a surface material according to the present invention comprises a fibrous structure having a weight average single fiber thickness of from 0.0001 to 1 dtex, a thickness of from 0.10 to 5 mm and a unit weight of from 50 to 500 g/m$^2$, and the surface material is disposed on a surface of a body to convert at least a part of a surface wave generated on the surface of the body by a vibration of the body into a vibration of the fibrous structure.

Further, a surface material according to the present invention comprises a fibrous structure which is formed by a group of extra fine fibers having a weight average single fiber thickness of from 0.0001 to 1 dtex, a Young's modulus of not more than 210 GPa and a fiber density of from 0.10 to 0.50 g/cm$^3$ and in which respective extra fine fibers exist at a condition capable of being vibrated relative to each other by a vibration energy, and the surface material is disposed on a surface of a body to convert at least a part of a surface wave generated on the surface of the body by a vibration of the body into a vibration of the fibrous structure.

A method for suppressing influence due to a surface wave according to the present invention comprises the steps of disposing a fibrous structure on a surface of a body, the fibrous structure having a weight average single fiber thickness of from 0.0001 to 1 dtex, a thickness of from 0.10 to 5 mn and a unit weight of from 50 to 500 g/m$^2$; and converting at least a part of a surface wave generated on the surface of the body by a vibration of the body into a vibration of the fibrous structure.

Further, a method for suppressing influence due to a surface wave according to the present invention comprises the steps of disposing a fibrous structure on a surface of a body, the fibrous structure being formed by a group of extra fine fibers having a weight average single fiber thickness of from 0.0001 to 1 dtex, a Young's modulus of not more than 210 GPa and a fiber density of from 0.10 to 0.5 g/cm$^3$ and respective extra fine fibers existing at a condition capable of being vibrated relative to each other by a vibration energy; and converting at least a part of a surface wave generated on the surface of the body by a vibration of the body into a vibration of the fibrous structure.

In the surface material and the method for suppressing influence due to a surface wave according to the present invention, at least a part of the surface wave, which is a transverse vibration caused on the surface of the body by the vibration of the body, is converted into a vibration of the specified fibrous structure which is disposed on the surface of the body. In the interior of this specified fibrous structure, it is not performed that a member itself vibrates integrally, thereby absorbing or damping a transmitted vibration, but the respective fibers forming the fibrous structure mutually vibrate, thereby removing or suppressing the undesirable non-stationary noise component such as a high frequency component from the reflected vibration component and the re-propagated vibration component into the member. Therefore, by using the acoustic member or the member for handling image on which the surface material is disposed, distortional feeling and turbid feeling of the tone of the sound originating from the surface wave can be suppressed, or unclear feeling and unnatural feeling of the image quality can be suppressed, and vivid sound quality without turbid feeling or image quality with clear and natural color tone can be obtained.

THE BEST MODE FOR CARRYING OUT THE INVENTION

The surface material according to the present invention comprises a fibrous structure disposed on a surface of a body in order to suppress an influence due to a surface wave generated on the surface of the body by a vibration. In the present invention, the surface wave generated on the surface of the body by a vibration means a concave/convex wave on the surface which is propagated along the surface of the body by the stretching vibration of the body in a direction perpendicular to a direction of the progress of the vibration. The vibration given to the body includes a mechanical vibration other than an acoustic vibration.

The fibrous structure forming the surface material according to the present invention comprises a fibrous structure having a weight average single fiber thickness of from 0.0001 to 1 dtex, a thickness of from 0.10 to 5 mm and a unit weight of from 50 to 500 g/m$^2$, or a fibrous structure which is formed by a group of extra fine fibers having a weight average single fiber thickness of from 0.0001 to 1 dtex, a Young's modulus of not more than 210 GPa and a fiber density of from 0.10 to 0.50 g/cm$^3$ and in which respective extra fine fibers exist at a condition capable of being vibrated relative to each other by a vibration energy. Where, "existing at a condition capable of being vibrated relative to each other by a vibration energy" means a state wherein the vibration is not performed integrally with a base material (in the conventional acoustic absorption material, a base material is vibrated integrally), and means a state wherein the respective extra fine fibers can mutually vibrate at each fine portion in the fibrous structure.

The weight average single fiber thickness of the fibrous structure forming the surface material according to the present invention is from 0.0001 to 1 dtex. If the weight average single fiber thickness is less than 0.0001 dtex, the advantage according to the present invention becomes poor and it is not desirable, and if more than 1 dtex, there occur problems such as a problem in that noise of uncomfortable non-stationary component becomes great and it is not desirable.

In the present invention, the fibrous structure may be formed as a formation of a nonwoven fabric formed by short fibers or long fibers, or may be formed as a formation of a woven fabric or a knit fabric formed by long fibers or short fibers. The fibrous structure may be punched by water jet, and when the fibrous structure is formed as a woven or knit fabric, water jet punched state is preferred. Whether the fibrous structure is formed as a nonwoven fabric or as a woven or knit fabric may be decided depending on the kind of the influence due to the surface wave to be suppressed. For example, as to the tone of a sound on acoustic sense, because an appropriately vivid tone can be obtained when the surface material comprises a woven or knit fabric and a comfortableness with no peculiarity on the sound tone is likely to be given when the surface material comprises a nonwoven fabric, the material may be appropriately selected as needed, or the materials may be together used as an appropriate combination.

The thickness of the fibrous structure according to the present invention is from 0.10 to 5 mm, and when the fibrous structure is formed as a nonwoven fabric, preferably it is from 0.40 to 3 mm, and more preferably it is from 0.40 to 2 mm. When the fibrous structure is formed as a woven or knit fabric, the thickness is preferably from 0.15 to 3 mm, and more preferably from 0.15 to 2 mm. If the thickness is less than 0.10 mm, the aimed advantage for suppressing the influence due to the surface wave becomes poor. If the thickness is more than 5 mm, the aimed advantage for suppressing the influence due to the surface wave can be obtained, but the degree of the increase of the advantage becomes small, and because the thickness of the surface material is added to the surface of the body, there is a fear that the thickness of the body, ultimately, the size of the equipment becomes large unnecessarily.

The unit weight of the fibrous structure according to the present invention is from 50 to 500 g/m$^2$, and when the fibrous structure is formed as a nonwoven fabric, preferably it is from 100 to 400 g/m$^2$, and more preferably it is from 150 to 400 g/m$^2$. When the fibrous structure is formed as a woven or knit fabric, the unit weight is preferably from 50 to 200 gm$^2$, and more preferably from 60 to 120 g/m$^2$. If the unit weight is less than 50 g/m$^2$, the amount of fibers mutually vibrating becomes small, and the aimed advantage for suppressing the influence due to the surface wave becomes poor. If the unit weight is more than 500 g/m$^2$, the fiber density becomes too great, and it becomes difficult to vibrate the fibers mutually, and the aimed advantage for suppressing the influence due to the surface wave also becomes poor.

In the present invention, a nonwoven fabric forming the fibrous structure may be formed by either short fibers or long fibers, and in the case of short fibers, usually the length of the fiber is not less than 1 mm, and preferably in the range of from 30 to 70 mm.

In the present invention, the nonwoven fabric can be produced, for example, as follows.

A felt prepared by entangling divided type composite fibers comprising two or more components or sea/island type composite fibers by needle punching is coagulated, as needed, after polyurethane is impregnated as a binder, and thereafter, the divided type composite fibers are divided, or the sea/island type composite fibers are treated by removing the sea component, to make extra fine fibers, and further the obtained material is buff treated by sand paper, and as needed, at least the surface thereof is treated by raising.

In the present invention, the content of polyurethane is preferably from 0 to 50 wt. %, and more preferably from 20 to 50 wt. %, relative to the weight of the fibrous structure. If more than 50 wt. %, the intrinsic timbre of polyurethane is added, and it is difficult to a desired sound tone on acoustic sense and it is not preferred.

In the present invention, a nonwoven fabric prepared without impregnating polyurethane can be used. In this case, because the fibers are entangled more stably and there is no factor to obstruct the mutual vibration between the fibers, the respective fibers mutually can vibrate easily, and the surface wave of the body is converted into a vibration of the fibrous structure at a more desired condition. Therefore, the converted vibration is finely divided, an intrinsic vibration such as in an integral vibration, and an intrinsic noise based on the intrinsic vibration, do not occur. Namely, because polyurethane essentially is used as a binder, if a nonwoven fabric can be formed without using such a binder (that is, the content of polyurethane is zero), the state is most preferable from the point of view that the surface wave of the body is converted into a vibration of the fibrous structure.

In the present invention, the woven or knit fabric forming the fibrous structure can be produced as follows.

A woven or knit fabric is prepared from divided type composite fibers comprising two or more components or sea/island type composite fibers, and thereafter, the divided type composite fibers are divided, or the sea/island type composite fibers are treated by removing the sea component, to make extra fine fibers. The obtained woven or knit fabric may be further punched by water jet to entangle the extra fine fibers.

In the present invention, a woven or knit fabric forming the fibrous structure has an operation different from that by a nonwoven fabric, for example, the obtained sound tone has a characteristic different from that by a nonwoven fabric. Because the woven or knit fabric is thin and the surface is not treated by raising, the amount of absorbed sound is small and the amount of reflected sound is also small. However, when a sound enters, the fibrous structure functions as a rectifying lattice without generating noise in a high key sound region, and further, the induced vibration of the extra fine fibers is generated finely and relatively systematically. Namely, the sound transmitted through the surface material composed of the woven or knit fabric according to the present invention becomes clear and vivid without remarkably changing the tone of the original sound, and adds a delightful aftersound without reducing the clearness of the original sound.

The fibrous structure in the present invention may be a fibrous structure whose surface is covered with raised fibers comprising extra fine fibers. However, if the raised fibers are arranged regularly too much, the effect for suppressing the influence due to the surface wave generated by an acoustic vibration has a directivity, and a part of the reflected sound is emphasized or damped to make a sound having a distortional feeling or a turbid feeling, and therefore, the raised fibers preferably are arranged at an appropriate randomness.

As the index for indicating this randomness, for example, in the determination of a mean optical reflectance of the surface of the fibrous structure, preferably the mean optical reflectance is in the range of from 10 to 75% and a difference between the maximum optical reflectance and the minimum optical reflectance is not less than 2%. The mean optical reflectance in the present invention is determined from a luminous intensity of the light reflected from the fibrous structure, which is measured when an automatic angle changing photometer having a light source of a halogen lamp is used and the luminous intensity of the reflected light from a Mg white board prepared as a reference board for reflectance determination is referred to as 100%, and the mean optical reflectance is defined as an average value of three measurement data.

In the present invention, the Young's modulus of the extra fine fibers is preferably not more than 210 GPa. If the Young's modulus is more than 210 GPa, the flexibility disappears and the advantage becomes poor, and it is not preferable. More preferably the Young's modulus is in the range of from 0.4 to 130 GPa. If the Young's modulus is less than 0.4 GPa, it becomes too flexible and it becomes difficult that the fibers mutually vibrate. When the Young's modulus is not more than 130 GPa, a desired flexibility is obtained for the mutual vibration of the respective fibers.

Further, in the present invention, the fiber density of the extra fine fibers is in the range of from 0.10 to 0.50 g/cm$^3$, and preferably in the range of from 0.20 to 0.40 g/cm$^3$. If the fiber density is less than 0.10 g/cm$^3$, the weight per a unit volume of the fibrous structure becomes too small, and the amount of the converted energy becomes small. If the fiber density is more than 0.50 g/cm$^3$, a usable material of fibers is restricted and it is necessary to use an expensive material.

When the fibrous structure forming the surface material according to the present invention is disposed on a surface of a body, in the surface of the body, a surface wave generated by, for example, an acoustic vibration, can be converted into a vibration of the fibrous structure according to the present invention, thereby removing an unrecognizable sound on acoustic sense and an uncomfortable sound. This is because the vibration generated by the fibrous structure according to the present invention is like a so-called white noise which generally is present in the nature.

There are various forms for use of the surface material according to the present invention, and it is used by being disposed on the surfaces of vibration transmitting materials, non-vibrated materials, acoustic materials, etc. Particularly preferable examples applied to the present invention will be described below.

(a) Acoustic Equipment, Visual Equipment (Audio/Visual Equipment):

For example, a felt has been wound or bonded on inside parts of an amplifier in order to prevent its vibration. When the surface material comprising the fibrous structure composed of a nonwoven fabric according to the present invention was applied instead of the felt, effect for preventing the vibration remarkably increased, and effect for suppressing the noise originating from the surface wave was remarkably improved.

Further, when it was applied to optical or magnetic recording media and the devices thereof such as CD, CDR, DVD, MD, LD, MO and DAT, LP players, tape recorders, video decks, video cameras, microphones, microphone stands, camera stands, etc., great effect for improving the sound quality or the image quality could be obtained.

(b) Musical Instrument:

When the surface material comprising the fibrous structure composed of a woven or knit fabric according to the present invention was bonded on a wooden frame of an Italian cembalo, a clear sound could be obtained.

Further, when it was applied to a double fretted clavichord, the sound volume could be increased completely without damaging the expression created by the nice control of the player, and a deeply extending aftersound could be obtained.

When the surface material comprising the fibrous structure composed of a nonwoven fabric according to the present invention was bonded to the end of the bridge of the cembalo, the articulation became clear, and the flexibility of the variation of the sounds, which frequently conflicted with each other, also could be improved.

Further, when the above-described surface material was bonded on the outer corner of the body of the clavichord, the sound tone became limpid and clear. Furthermore, when the above-described surface material was replaced for a felt on a piano, the clearness and the sound tone were both improved.

(c) Interior Material:

Although there has been an acoustic absorption material such as an acoustic absorption ceiling material and the sound in a room has been suppressed, because the sound tone becomes rustling, there is a problem that a sense of fatigue is increased even in a case where the room is not made as a particular acoustic room.

When the surface material comprising the fibrous structure composed of a woven or knit fabric according to the present invention was bonded on a wall positioned rear a speaker's chair in a convention hall, the voice could be clearly transmitted, and not only it became easy to be listened but also the advantage for decreasing the fatigue of the speaker could be obtained. Even in a case where it was placed after making it as a panel or a folding screen, a close advantage could be obtained.

When the surface material comprising the fibrous structure composed of a nonwoven fabric according to the present invention is applied to a ceiling or a wall, because the sound can be naturally suppressed without giving damage to the clearness of the sound, if it is applied to a meeting room or a reception room or in a hotel, an excellent space can be provided in human engineering.

Further, in music halls, even if the stationary reverberation properties are almost same, completely different acoustic properties in the halls are frequently indicated. Further, the wooden acoustic property is indicated in any hall which uses wood to a great extent, and the stone acoustic property is indicated in any hall which uses stone to a great extent. This characteristic originates from the reason that the human acoustic sense mainly depends on transient property. Furthermore, even in a music hall, a portion behind audience seats and chairs of the audience seats are generally made with a sound absorbing property. However, in the conventional acoustic absorption material and sound absorbing structure, a reflected component that is not absorbed is converted into an intrinsic sound, and it is extremely uncomfortable to the human acoustic sense, and therefore, it causes the sound to be deteriorated.

By using the surface material comprising the fibrous material composed of a nonwoven fabric according to the present invention as a bonding material for the chairs, even if there were some empty seats and the reverberation increased to some extent, the sound did not become unclear. Further, When the surface material was used for finish of the sound absorbing portion behind the audience seats, the sound quality in the rear seats was improved.

By using the surface material comprising the fibrous material composed of a woven or knit fabric according to the present invention for finish of the ceiling and the portion behind the stage, a smooth and clear sound without damaging the characteristics of the players and the music instrument, that is, without peculiarity, could be obtained.

EXAMPLES

The present invention will be explained in more detail with reference to examples. The property indicated in the examples was determined by the following method.

Mean Optical Reflectance

Changing over an automatic angle changing photometer GP-1R (produced by Murakami Color Research Corporation) prepared as a measuring apparatus, a light was focused at a 10 cm position before a sample by a convex lens, the emitted light was controlled so that the circular light of a diameter of 4 mm was focused at the surface of the sample and the sample was set at a predetermined position, and the sample was moved in a horizontal direction at a speed of 1.2 cm/min. using a servomotor. The movement distance was 4 cm. A light was emitted onto the sample at an incident angle of 45 degrees, a reflected light was caught at a position of a reflective angle of 45 degrees and it was automatically recorded on a chart.

Using a halogen lamp of 12 V, 50 W as a light source lamp and a Mg white board as a reference board for reflected light, the optical reflectance was determined as an luminous intensity of the reflected light from the sample when the luminous intensity of the reflected light from the Mg white board was referred to as 100%. In this determination, the chart speed was 3 cm/min., the chart width of 25 cm was determined as a value corresponding to an optical reflectance of 100%, and the mean optical reflectance was defined as an average value of three measurement data.

Example 1

A surface material of a nonwoven fabric with a thickness of 1 mm and a unit weight of 290 g/m$^2$ was prepared, which was composed of polyethylene terephthalate fibers (Young's modulus: 9.8 GPa, specific gravity: 1.38) entangled by needle punching and having a weight average single fiber thickness of 0.04 dtex, a fiber length of 51 mm and a crimp number of 14/inch.

The surface material was bonded onto the whole surface of a speaker and a music was regenerated. When the sensory test of the sound tone was performed by audience of 10 people elected randomly, the tone became clear and vivid without turbid feeling.

Example 2

Dimethylformamide solution of polyurethane resin, whose 100% stress of a dried film determined based on JIS-K6031 (3 rank dumbbell, thickness: 0.2 mm, tensile speed: 500 mm/min.) was 5 MPa, was impregnated into the nonwoven fabric obtained in Example 1 so that the content of polyurethane was 30 wt. % relative to the weight of the fibers, and thereafter, it was wet coagulated. Then, the surface was buff treated by a sand paper, thereby raising extra fine fibers thereon to prepare a leather-like surface material with a thickness of 0.6 mm and a unit weight of 170 g/m$^2$. The mean optical reflectance of the extra fine fibers was 43.3%, the maximum optical reflectance was 47.6%, and the minimum optical reflectance was 41.5%.

When the surface material prepared was bonded onto an optical pickup of a DVD player and the sensory test was performed in the same manner as in Example 1, the sound tone became clear and vivid without turbid feeling, and the image quality became clear and indicated a natural color tone. This was because jitter in a high frequency region, which had been difficult to be removed in the conventional technology, was remarkably decreased.

Example 3

A surface material of a woven fabric with a thickness of 1 mm and a unit weight of 61 g/m$^2$ formed as a plain weave structure with a unit weight of 150 warps/inch and 110 wefts/inch was prepared, which was composed of polyethylene terephthalate multifilament with a weight average single fiber thickness of 0.08 dtex and a filament number of 680 (Young's modulus: 9.8 GPa, specific gravity: 1.38).

When the surface material was used as a wall material of a salon hall and the sound quality of the played instrument was determined by the same sensory test as in Example 1, the sound tone became clear and vivid without turbid feeling, and fatigue was hard to be generated even for a long time.

Comparative Example 1

A surface material of a nonwoven fabric with a thickness of 1 mm and a unit weight of 290 g/m$^2$ was prepared, which was composed of polyethylene terephthalate fibers with a weight average single fiber thickness of 3.3 dtex, a fiber length of 51 mm and a crimp number of 13/inch (Young's modulus: 9.8 GPa, specific gravity: 1.38).

When the surface material was bonded onto the whole surface of a speaker and a music was regenerated and the sound quality was determined by the same sensory test as in Example 1, the sound tone had turbid feeling, and the vividness disappeared, and it was not good as compared with that of Example 1.

Comparative Example 2

When a worsted felt was used and the same sensory test of the sound quality as that in Example 1 was performed, the sound tone had turbid feeling and no vividness, and it was not preferable.

Example 4

When the surface material prepared in Example 3 was laminated on the surface of a base material of a wooden board and it was used as an acoustic reflector, the sound tone obtained was clear.

Example 5

When the surface material prepared in Example 2 was used as a member for suppressing the influence due to the surface wave and it was bonded on the surfaces of a body of a microphone and a microphone stand and the audience test was performed, the sound tone obtained was clear.

Example 6

When the surface material prepared in Example 2 was bonded on a caster portion of a piano and the audience test of the played piano was performed, the sound tone obtained was clear.

Example 7

When the surface material prepared in Example 2 was laminated on a surface of a base metal material portion of a partition on the market which was made from glass and metal, and the conversation in the inside separated from outside by the partition was tested, the voice in the conversation was clear and further the fatigue feeling was remarkably decreased.

Example 8

When the surface material prepared in Example 2 was bonded on a video camera, the image quality obtained was clear and it indicated a natural color tone.

Example 9

When the surface material prepared in Example 2 was bonded on a DAT tape case, the sound tone was clear and vivid without turbid feeling.

Example 10

Using sea/island type fibers with a mean fiber fineness of 3.5 dtex, which composed of 60 parts of polyethylene terephthalate as the island component and 40 parts of polystyrene as the sea component and the 36 islands of the island component was contained in one filament, a needle punched felt was formed by a regular method. The unit weight of the felt was 350 g/m. Polyvinyl alcohol solution was impregnated into the felt, and after dried, the sea component was decomposed and removed by trichloroethylene and polyurethane solution was impregnated thereinto, and the polyurethane was coagulated in water. Further, drying after removing polyvinyl alcohol by dipping it into hot water, the surface was buffed and raised fibers were formed. After this sheet was dyed, using a rotational brush at a condition of still wet state, the surface was scratched so that the raised fibers became random, and thereafter it was dried.

The fineness of the extra fine fibers of the obtained sheet was 0.06 dtex, and the Young's modulus thereof was 9.8 GPa. The mean optical reflectance of the sheet was 34.3%, the maximum optical reflectance was 37%, and the minimum optical reflectance was 31.5%.

When the sound quality with respect to the sheet was determined by the same sensory test as in Example 1, the sound tone was vivid without turbid feeling and it was preferable.

Example 11

In Example 10, the still wet sheet after dyed was uniformly regulated in fiber arrangement in the longitudinal direction by the rotational brush, and thereafter it was dried. The fineness of the extra fine fibers of the obtained sheet was 0.06 dtex, and the Young's modulus thereof was 9.8 GPa. The mean optical reflectance of the sheet was 40.3%, the maximum optical reflectance was 41%, and the minimum optical reflectance was 39.7%.

When the sound quality with respect to the sheet was determined by the same sensory test as in Example 1, the vividness of the sound tone and the effect for improving against turbid feeling were slightly poor as compared with those in Example 10.

Industrial Applications of the Invention

In the surface material according to the present invention, undesirable influence to sound quality and image quality due to the surface wave, which is generated on a surface of a body as a transverse vibration, can be effectively suppressed, thereby obtaining an effect for suppressing the vibration component originating from the surface wave, that cannot be achieved merely by increasing a rigidity of a base material forming the body or conducting vibration proofing. Therefore, by disposing this surface material on the surfaces of various members receiving vibration, the modulation of the vibration originating from the surface wave which greatly influences the human acoustic sense can be efficiently suppressed, and the deterioration of the sound quality and the image quality obtained can be prevented.

What is claimed is:

1. A surface material comprising a nonwoven fabric formed from short non glass fibers with a single fiber fineness of from 0.0001 to 1 dtex and having a thickness of from 0.10 to 5 mm and a weave density of from 50 to 500 g/m$^2$, said surface material being disposed on a surface of a body to convert at least a part of a surface wave generated on said surface of said body by a vibration of said body into a vibration of said nonwoven fabric.

2. The surface material according to claim 1, wherein said nonwoven fabric contains urethane at a content of not more than 50 wt. %.

3. The surface material according to claim 2, wherein said nonwoven fabric contains urethane at a content of 25 to 50 wt. %.

4. The surface material according to claim 1, wherein said nonwoven fabric is punched by needle or water jet.

5. The surface material according to claim 1, wherein a surface of said nonwoven fabric is covered with raised fibers of extra fine fibers, a mean optical reflectance of the surface is in the range of from 10 to 75%, and a difference between a maximum optical reflectance and a minimum optical reflectance is not less than 2%.

6. A surface material comprising a nonwoven fabric which is formed from a group of extra fine short non glass fibers having a single fiber fineness of from 0.0001 to 1 dtex, a Young's modulus of not more than 210 GPa and a fiber density of from 0.10 to 0.50 g/cm$^3$ and in which respective extra fine non glass short fibers exist at a condition capable of being vibrated relative to each other by a vibration energy, said surface material being disposed on a surface of a body to convert at least a part of a surface wave generated on said surface of said body by a vibration of said body into a vibration of said nonwoven fabric.

7. The surface material according to claim 6, wherein said nonwoven fabric contains urethane at a content of not more than 50 wt. %.

8. The surface material according to claim 7, wherein said nonwoven fabric contains urethane at a content of 25 to 50 wt. %.

9. The surface material according to claim 6, wherein said nonwoven fabric is punched by needle or water jet.

10. The surface material according to claim 6, wherein a surface of said nonwoven fabric is covered with raised fibers of extra fine fibers, a mean optical reflectance of the surface is in the range of from 10 to 75%, and a difference between a maximum optical reflectance and a minimum optical reflectance is not less than 2%.

11. A surface material comprising a woven fabric or knit fabric formed from non glass fibers with a single fiber fineness of from 0.0001 to 1 dtex and having a thickness of from 0.10 to 5 mm and a weave density of from 50 to 500 g/m$^2$, said surface material being disposed on a surface of a body to convert at least a part of a surface wave generated on said surface of said body by a vibration of said body into a vibration of said woven fabric or knit fabric.

12. The surface material according to claim 11, wherein said woven fabric or knot fabric is punched by water jet.

13. The surface material according to claim 11, wherein a surface of said woven fabric or knit fabric is covered with raised fibers of extra fine fibers, a mean optical reflectance of the surface is in the range of from 10 to 75%, and a difference between a maximum optical reflectance and a minimum optical reflectance is not less than 2%.

14. A surface material comprising a woven fabric or knit fabric which is formed from a group of extra fine non glass fibers having a single fiber fineness of from 0.0001 to 1 dtex, a Young's modulus of not more than 210 GPa and a fiber density of from 0.10 to 0.50 g/cm$^3$ and in which respective extra fine non glass fibers exist at a condition capable of being vibrated relative to each other by a vibration energy, said surface material being disposed on a surface of a body to convert at least a part of a surface wave generated on said surface of said body by a vibration of said body into a vibration of said woven fabric or knit fabric.

15. The surface material according to claim 14, wherein said woven fabric or knit fabric is punched by water jet.

16. The surface material according to claim 14, wherein a surface of said woven fabric or knit fabric is covered with raised fibers of extra fine fibers, a mean optical reflectance of the surface is in the range of from 10 to 75%, and a difference between a maximum optical reflectance and a minimum optical reflectance is not less than 2%.

17. A method for suppressing influence due to a surface wave comprising the steps of:

disposing a nonwoven fabric on a surface of a body, said nonwoven fabric formed from short non glass fibers with a single fiber fineness of from 0.0001 to 1 dtex and having a thickness of from 0.10 to 5 mm and a weave density of from 50 to 500 g/m$^2$; and converting at least a part of a surface wave generated on said surface of said body by a vibration of said body into a vibration of said nonwoven fabric.

18. A method for suppressing influence due to a surface wave comprising the steps of:

disposing a woven fabric or knit fabric on a surface of a body, said woven fabric or knit fabric formed from non glass fibers with a single fiber fineness of from 0.0001 to 1 dtex and having a thickness of from 0.10 to 5 mm and a weave density of from 50 to 500 g/m$^2$; and converting at least a part of a surface wave generated on said surface of said body by a vibration of said body into a vibration of said woven fabric or knit fabric.

19. A method for suppressing influence due to a surface wave comprising the steps of:

disposing a nonwoven fabric on a surface of a body, said nonwoven fabric being formed from a group of extra fine short non glass fibers having a single fiber fineness of from 0.0001 to 1 dtex, a Young's modulus of not more than 210 GPa and a fiber density of from 0.10 to 0.50 g/cm$^3$ and respective extra fine short non glass fibers existing at a condition capable of being vibrated relative to each other by a vibration energy; and converting at least a part of a surface wave generated on said surface of said body by a vibration of said body into a vibration of said nonwoven fabric.

20. A method for suppressing influence due to a surface wave comprising the steps of:

disposing a woven fabric or knit fabric on a surface of a body, said woven fabric or knit fabric being formed from a group of extra fine non glass fibers having a single fiber fineness of from 0.0001 to 1 dtex, a Young's modulus of not more than 210 GPa and a fiber density of from 0.10 to 0.50 g/cm$^3$ and respective extra fine non glass fibers existing at a condition capable of being vibrated relative to each other by a vibration energy; and converting at least a part of a surface wave generated on said surface of said body by a vibration of said body into a vibration of said woven fabric or knit fabric.

21. The surface material according to any one of claims 1, 6, 11 or 14, wherein the short fibers have a length of 1–70 mm.

22. The method according to any of claims 17, 18, 19 or 20, wherein the short fibers have a length of 1–70 mm.

* * * * *

UNITED STATES PATENT AND TRADEMARK OFFICE

CERTIFICATE OF CORRECTION

PATENT NO. : 6,702,063 B1
DATED : March 9, 2004
INVENTOR(S) : Yamaguchi et al.

It is certified that error appears in the above-identified patent and that said Letters Patent is hereby corrected as shown below:

Column 10,
Line 9, please change "350 g/m" to -- 350 $g/m^2$ --.

Signed and Sealed this

Twenty-first Day of December, 2004

JON W. DUDAS
*Director of the United States Patent and Trademark Office*